United States Patent [19]

Shudo et al.

[11] Patent Number: 4,526,121

[45] Date of Patent: Jul. 2, 1985

[54] SHIP FOR TREATING COAL SLURRY

[75] Inventors: Yasunobu Shudo; Masayoshi Kano; Tatsuya Murahashi; Yasuo Nakai; Kazuyoshi Hosogaya, all of Osaka, Japan

[73] Assignee: Hitachi Shipbuilding & Engineering Co., Ltd., Osaka, Japan

[21] Appl. No.: 412,936

[22] Filed: Aug. 30, 1982

[51] Int. Cl.[3] ..... B63B 25/04

[52] U.S. Cl. ..... 114/73; 210/384; 210/388; 406/39; 414/144

[58] Field of Search ..... 75/3; 414/144, 145; 406/82, 39, 154; 114/73; 210/198.1, 260, 384, 388, 499

[56] References Cited

U.S. PATENT DOCUMENTS 824,905 7/1906 Christenson ..... 210/384
1,164,934 12/1915 Dull ..... 414/144 X
3,057,481 10/1962 Pall ..... 210/499
4,234,320 11/1980 Verschuur ..... 75/3
4,330,413 5/1982 Wilson ..... 210/388

FOREIGN PATENT DOCUMENTS 2084257 4/1982 United Kingdom ..... 114/73

*Primary Examiner*—Sherman D. Basinger
*Attorney, Agent, or Firm*—Armstrong, Nikaido, Marmelstein & Kubovcik

[57] ABSTRACT

A ship for treating a coal slurry comprising a pair of opposed trays disposed in the vicinity of the upper deck for causing the coal slurry supplied thereto to flow forward and delivering the slurry, a slanting dewatering screen disposed below each of the trays for dewatering the coal slurry delivered from the tray to separate a particulate coal fraction having relatively large particle sizes, and conveyors for transporting to a specified position on the upper deck the particulate coal fraction dewatered and falling off the screen.

12 Claims, 14 Drawing Figures

SHIP FOR TREATING COAL SLURRY

BACKGROUND OF THE INVENTION

The present invention relates to a ship for treating a coal slurry to transport the coal slurry as loaded in its own holds or to load the slurry into the holds of another ship.

Generally coal is transported by land from coal mining areas to loading ports, where it is loaded into ships for transport by sea. To reduce the cost of transport by land and also to assure an efficient loading operation at the port, is it frequently practice in recent years to disperse pulverized coal in water in the mining area to obtain a coal slurry, transport the coal slurry to the port through a pipeline and thereafter load the slurry into a ship also through a pipeline. This method is very advantageous in that coal can be automatically loaded into the ship with use of a floating hose or the like which is supported by a buoy and connected to a facility on the shore without mooring the ship alongside a wharf. However, the usual coal slurry to be loaded into ships by pipelines contains, for example, about 50 to 70% by weight of water, so that the coal slurry is inefficient to transport as it is and requires a prohibitively high transport cost since the amount of coal that can be loaded into the ship is smaller by an amount corresponding to the water content. To enable the ship to transport coal with an improved efficiency, it is required to drain the coal slurry to the greatest possible extent and thereby load the ship with as much coal as possible. Further as an increasing amount of coal is loaded into the hold, coal particles settle, permitting a portion of the slurry water to collect above the mass of coal particles. Accordingly if the ship rolls while transporting the coal slurry in this state, the overlying portion of slurry water heaves to pose the hazard of pronounced rolling or is likely to strike against the hatch cover or flow out from the hold. Such a problem similarly arises also when the ship rolls during loading. The slurry water collecting above the mass of coal particles during loading must therefore be discharged as promptly as possible in order to eliminate the above objection and to assure an efficient slurry loading operation.

With conventional coal slurry transport ships, the coal slurry is directly transported into the hold and dewatered through drain outlets equipped with a filter and provided in the bottom of the hold, but it is difficult to efficiently discharge the slurry water from the bottom drain outlets. Thus there is the problem that such ships are low in coal slurry loading efficiency.

SUMMARY OF THE INVENTION

The main object of the present invention is to provide a coal slurry treating ship for shipping a coal slurry while dewatering the coal slurry to thereby assure an efficient loading operation and efficient transport of coal by sea.

To fulfill this object, the present invention provides a ship for treating a coal slurry comprising coal slurry delivery means disposed in the vicinity of the upper deck for causing the coal slurry supplied thereto to flow forward and delivering the slurry, a slanting dewatering screen disposed below the delivery means for dewatering the coal slurry delivered from the means to separate a particular coal fraction having relatively large particle sizes, and conveyor means for transporting to a specified position on the upper deck the particulate coal fraction dewatered and falling off the screen.

DESCRIPTION OF THE PREFERRED EMBODIMENTS

FIGS. 1 to 8 show a first embodiment of the invention.

Figure 1:
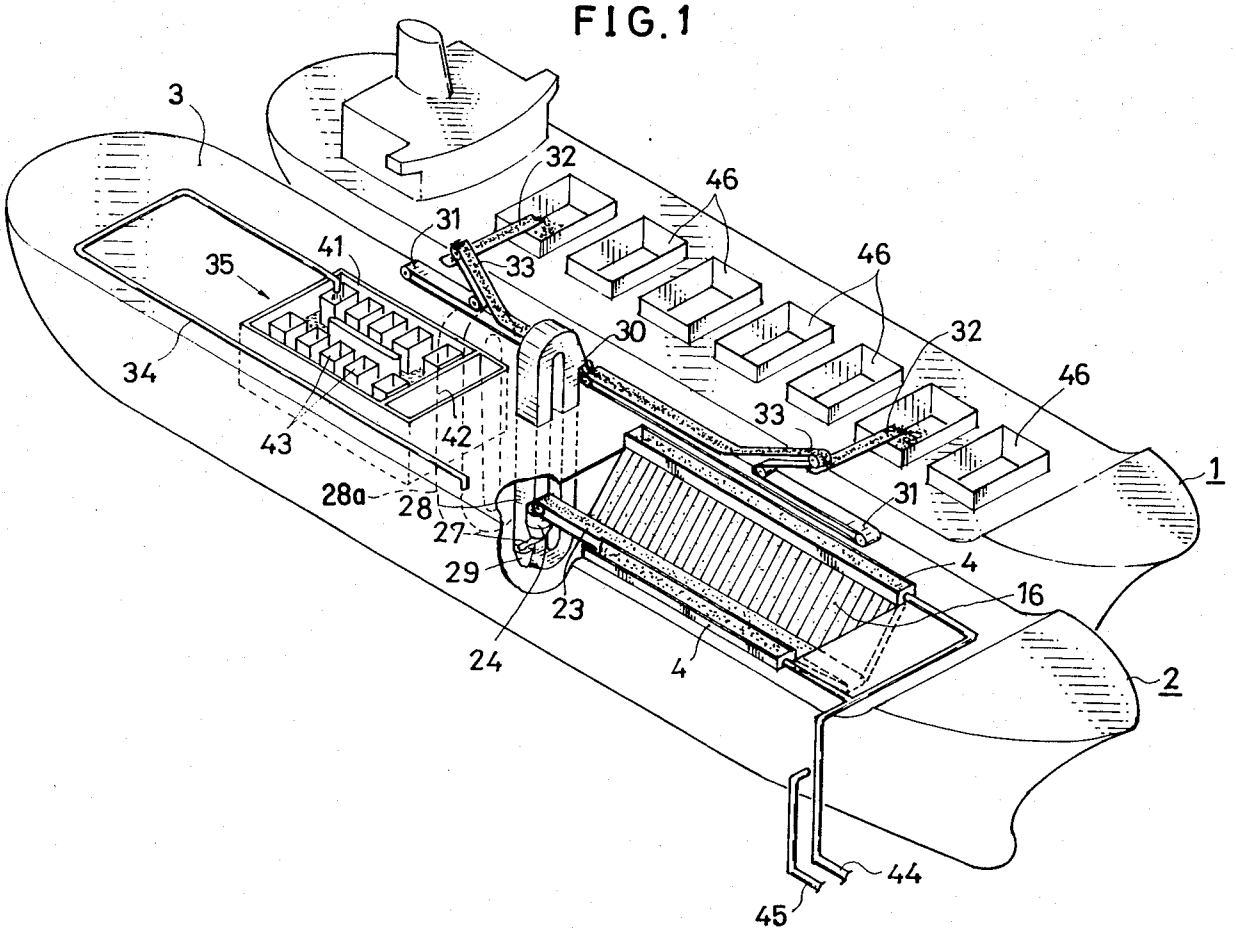
FIG. 1 is a perspective view showing a coal slurry treating ship embodying the invention and a coal transport ship.

FIG. 1 shows a coal transport ship 1 and a coal slurry treating ship 2. The transport ship 1 has a plurality of holds. The treating ship 2 serves as a coal slurry loading ship by which a coal slurry forwarded by land is loaded into the holds of the ship 1 while being dewatered.

Figure 2:
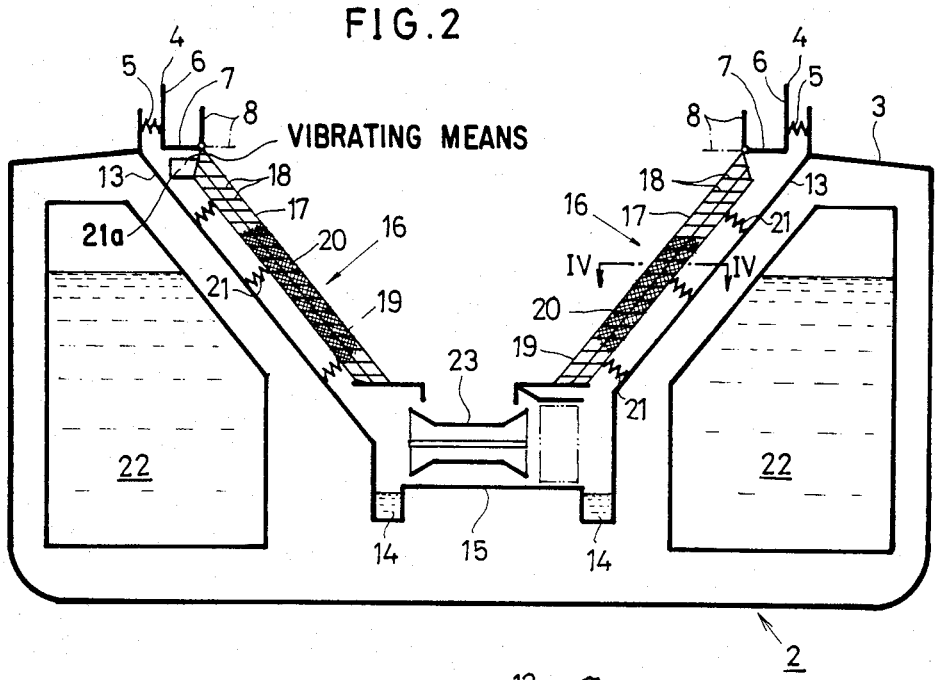
FIG. 2 is a cross sectional view showing the slurry treating ship of FIG. 1.
Figure 3:
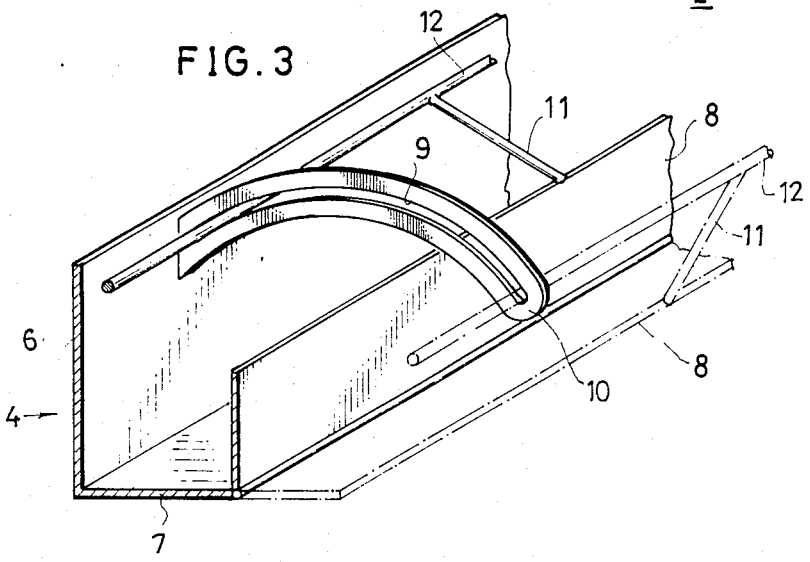
FIG. 3 is an enlarged perspective view showing part of a tray illustrated in FIG. 2.
Figure 4:
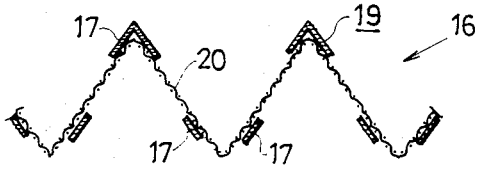
FIG. 4 is an enlarged view in section taken along the line IV—IV in FIG. 2.

The upper deck 3 of the ship 2 is provided at its front portion with trays 4 extending fore and aft along the opposite sides of the ship. As seen in FIGS. 2 and 3, each of the trays 4 comprises an outer side plate 6 attached to the hull by a multiplicity of shaking springs 5, a bottom plate 7 integral with the lower end of the outer side plate 6, and an inner side plate 8 water-tightly pivoted to the inner end of the bottom plate 7. The tray outer side plate 6 is provided with guide arms 10 each having a circular arc guide slit 9 and attached at its one end to an upper portion of the plate 6. A revolving rod 12 attached to the revolving end of the inner side plate 8 by a large number of connecting rods 11 is movably inserted through the slits 9 of the guide arms 10. A hydraulic cylinder (not shown) installed in a suitable location on the hull for opening and closing the inner side plate 8 has a rod connected to the revolving rod 12. The tray 4 is closed at its starting and terminal ends. Provided below the tray 4 at either side of the treating ship 2 is a slanting plate 13 extending obliquely downward from the upper deck 3 toward the center of the hull for receiving slurry water. A horizontal plate 15 is provided between a pair of slurry water drain channels 14 each disposed at the lower end of the slanting plate 13. Below each tray 4 a dewatering screen 16 extends along the slanting plate 13. The dewatering screen 16 comprises a metal net 20 extending over and attached to a holding frame 19 which comprises a multiplicity of vertical members 17 extending in parallel to the plate 13 and horizontal members 18 connecting the members 17 together as seen in FIGS. 2 and 4. The screen 16 is in the form of triangular waves in horizontal section to afford an increased surface area. The holding frame 19 of the screen 16 is attached to the slanting plate 13 by a multiplicity of shaking springs 21. The dewatering screen 16 and the tray 14 are provided with shaking or vibrating means shown at 21*a* in a "black box" representation and installed at suitable locations. A tank 22 for holding deashed slurry water is provided below the slanting plate 13 and the upper deck 3.

Figure 5:
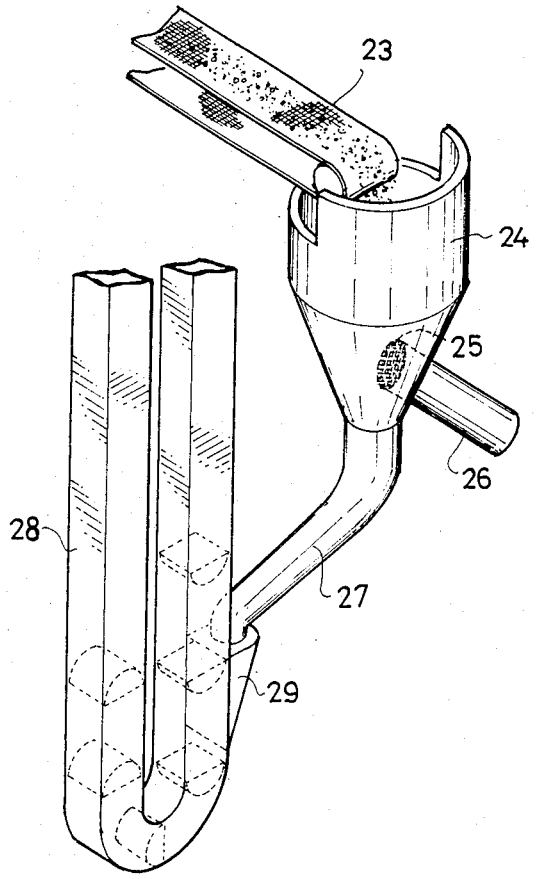
FIG. 5 is an enlarged perspective view partly showing a belt conveyor and a bucket conveyor illustrated in FIG. 1.

A belt conveyor 23 made of metal netting for receiving a particulate coal fraction dewatered and falling off the opposed dewatering screens 16 and transporting the coal fraction to the center of the hull is mounted on the horizontal plate 15 below the screens 16. As seen in FIG. 5, a hopper 24 for separating slurry water is disposed at the terminal end of the conveyor 23. A drain pipe 26 is connected to the lower slanting wall of the hopper 24 with a drain filter 25 provided therebetween. A chute 27 attached to the lower end of the hopper 24 for discharging the coal fraction is connected to an inlet lower portion 29 of a bucket conveyor 28 disposed in the center of the hull. The bucket conveyor 28 has an outlet upper portion 30 which is positioned above the upper deck 3 at one side of the ship 2.

Figure 6:
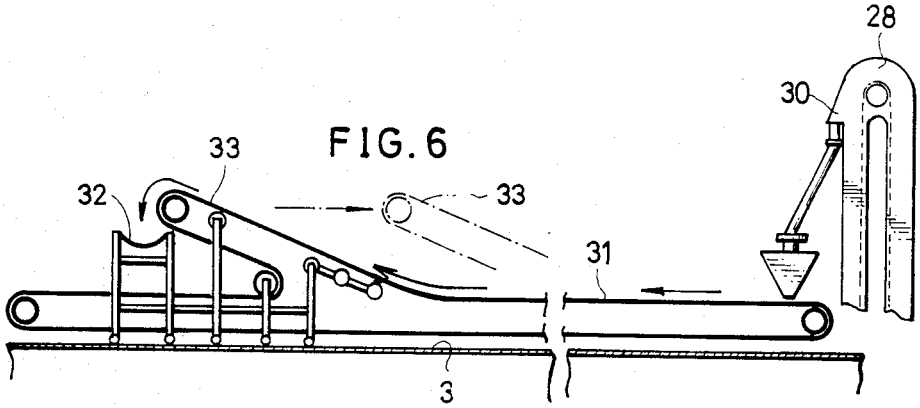
FIG. 6 is a fragmentary side elevation on an enlarged scale showing conveyor means on the upper deck seen in FIG. 1.

Belt conveyors 31 extending lenghtwise of the ship 2 in front and rear of the bucket conveyor 28 are mounted on the upper deck 3 at the above-mentioned side of the ship 2. A loader 32 movable fore and aft is provided for each of the belt conveyors 31. As seen in FIG. 6, the belt conveyor 31 includes an intermediate upward brush portion 33, and the loader 32 is positioned under the forward end of the branch portion 33. The branch portion 33 of the belt conveyor 31 is movable forward and rearward with the forward or rearward movement of the loader 32.

Figure 7:
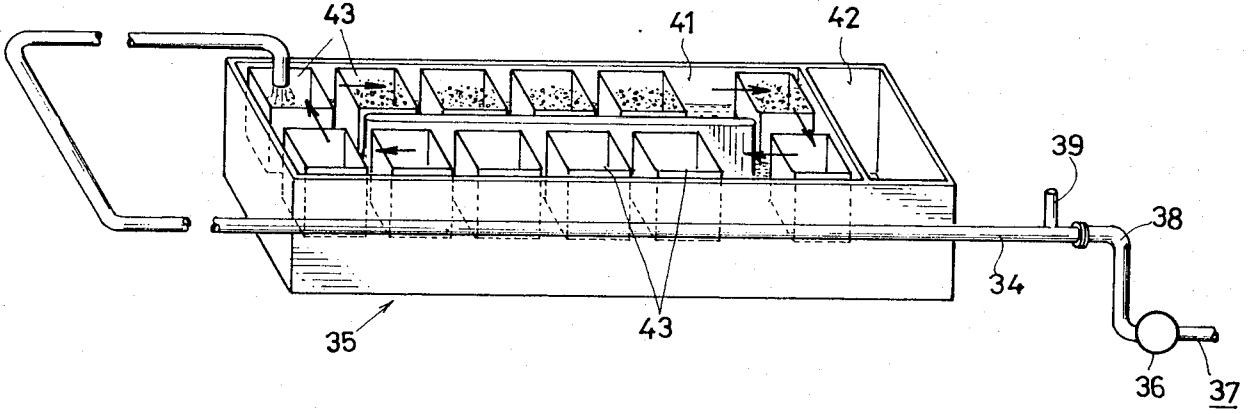
FIG. 7 is an enlarged perspective view showing an agglomerating pipe and a dewatering unit illustrated in FIG. 1.
Figure 8:
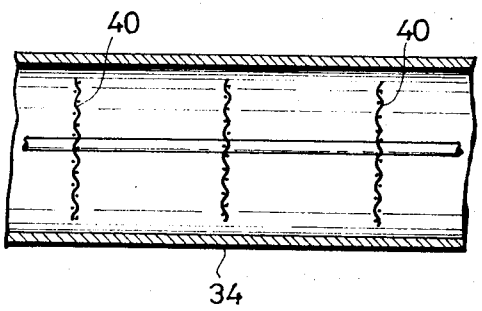
FIG. 8 is a fragmentary enlarged view in longitudinal section showing the agglomerating pipe of FIG. 7.

The ship 2 has an agglomerating pipe 34 extending on the rear portion of the upper deck 3 and terminating at a unit 35 for dewatering agglomerates. As shown in FIG. 7, a water feeder 37 comprises a pump 36 or the like for supplying the slurry water passing through the screens 16, and a conduit 38 connected to the starting end of the agglomerating pipe 34. An oil adding nozzle 39 is connected to the pipe 34 in the vicinity of its starting end. The agglomerating pipe 34 is provided with agitating blades 40 in its interior (see FIG. 8). The dewatering unit 35 comprises a box-shaped slurry water reservoir 41, an agglomerate receptacle 42 disposed at one end of the reservoir 41, and agglomerate containers 43 floating in the slurry water within the reservoir 41 and movable in circulation. The side wall of each container 43 has a dewatering metal net (not shown) positioned above the water level. Shown at 28*a* the treating ship 2 is centrally provided with a bucket conveyor which has the same construction as the one already described and by which the coal agglomerates dewatered and delivered from the receptacle 42 of the dewatering unit 35 are transported to the belt conveyor 31 on the upper deck 3.

Coal is loaded into the transport ship 1 by the treating ship in the following manner.

First, the transport ship 1 is laid along the side of the ship 2 where the belt conveyors 31 are positioned. A floating hose 44 for supplying a slurry is connected to the starting end of each tray 4, and a floating hose 45 for returning slurry water is connected to each slurry water tank 22 of the ship 2. The floating hoses are supported by buoys or the like and connected to a facility on shore. The coal slurry sent forward from the land facility through the hose 44 is introduced into each tray 4 with its inner side plate 8 closed as shown in solid lines in FIGS. 2 and 3. The slurry is caused to flow along the tray 4 over the entire length thereof. When the tray 4 is filled with the slurry, the tray inner side plate 8 is opened as shown in broken lines in FIGS. 2 and 3 to deliver the slurry uniformly over the dewatering screen 16. The tray inner side plate 8 is closed again to hold another supply of slurry therein. The slurry discharged onto each screen 16 contains coarse coal particles having relatively large sizes and fine coal particles having relatively small sizes. The slurry water containing fine coal particles passes through the net 20 of the screen 16, while coarse coal particles remain on the net 20. The coarse coal particles thus dewatered and separated from the fine coal particles fall along the net 20 onto the belt conveyor 23 of metal netting due to the vibration of the screen 16, transported to the center of the ship while being further dewatered with the netting of the conveyor 23, placed into the hopper 24, further dewatered by the filter 25 and placed into the inlet portion 29 of the bucket conveyor 28, carried upward above the upper deck 3 and delivered onto the belt conveyor 31 by the bucket conveyor 28, transferred from the branch portion 33 of the conveyor 31 to the loader 32, and loaded into one of the holds of the ship 1 through the hatch 46 thereof. The loader 32 is suitably moved lengthwise of the ship to load the coarse particulate coal fraction into one hold after another. On the other hand, the slurry water passing through each screen 16 flows down the slanting plate 13 into the drain channel 14 and is temporarily held in a suitable location within the hull along with the slurry water flowing through the netting of the conveyor 23 into the drain channel 14 and with the slurry water collected by the drain pipe 26 of the hopper 24. The slurry water is sent to the starting end of the agglomerating pipe 34 by the water feeder 37. A binder, such as fuel oil or like oil, is added via the nozzle 39 to the water within the pipe 34. While the slurry water is being forwarded to the terminal end of the pipe 34, the water and the binder are agitated and mixed together by the agitating blades 40, whereby the fine coal particles in the slurry water are agglomerated. Since coal and oil generally have affinity for each other, the binder oil adheres to the surfaces of fine coal particles, and other fine coal particles further adhere to the binder coatings. Thus agglomeration proceeds to afford coal agglomerates of increased sizes. The agglomerates thus obtained are delivered from the terminal end of the pipe 34 into the containers 43 of the dewatering unit 35 and are dewatered to some extent while each container 43 is traveling to the position of the receptacle 42, into which the agglomerates are placed, for example, by turning the container 43 upside down or by using suitable means. The agglomerated coal fraction placed into the receptacle 42 is further dewatered and, in the same manner as above, is transferred from the bucket conveyor to the belt conveyor 31 on the upper deck 3. The fraction is then loaded into the hold of the transport ship 1 along with the particulate coal fraction. The slurry water collecting in the reservoir 41 of the dewatering unit 35 contains ash, which settles on the bottom of the reservoir 41. Only the slurry water separated from the ash is led into the tank 22 by suitable means and is thereafter returned to the land facility via the hose 45. The ash sediment in the reservoir 41 is separated from the slurry water by suitable means and carried ashore by a barge or the like.

Conversely the treating ship 2 may be used for unloading. In this case, the side of the ship 2 provided with the belt conveyors 31 is laid alongside the wharf. Particulate coal transported on board as dewatered to some extent is made into a slurry again, supplied to the trays 4 of the ship 2 and landed by loders 32 while being dewatered.

The invention is not limited to the foregoing embodiment in respect of the constructions and arrangement of the tray 4, dewatering screen 16, belt conveyor 23, bucket conveyor 28, belt conveyor 31, loader, dewatering unit 35, etc., but these components can be modified suitably and arranged differently. For example, the bucket conveyor 28 may be disposed at a front or rear portion of the ship 2. This arrangement necessitates only one belt conveyor 31 and only one loader 32 on the upper deck 3. The ship 2 may be additionally provided at its rear portion with an assembly including trays 4, dewatering screens 16, etc. for dewatering agglomerates, with the terminal end of the agglomerating pipe 34 connected to the starting end of each tray 4. In this case, the slurry of agglomerates is dewaterd with the screen 16, and the slurry water separated off by the screen 16, etc. is led into the tank 22. Further instead of providing the agglomerating pipe 34, dewatering unit 35, etc., the slurry water separated from the particulate coal fraction by the screen 16, belt conveyor and hopper 24 may be returned to the facility on shore. The means for delivering the coal slurry to the screen 16 is not limited to the tray 4 insofar as the coal slurry supplied can be caused to flow forward and delivered onto the screen. Further the means for transporting the dewatered particulate coal fraction to a specified location above the upper deck are not limited to those of the above embodiment.

Thus coal slurries can be loaded into a transport ship by the treating ship of FIGS. 1 to 8 while being dewatered efficiently. This assures efficient transport of coal on board. Because dewatered coal particles are loaded into the holds of the transport ship, no slurry water will collect above the mass of coal particles during loading. This totally eliminates the objections already stated and resulting from the heave of slurry water. The treating ship is adapted to agglomerate fine coal particles contained in the slurry water separated from a particulate coal fraction having relatively large particle sizes, so that the coal slurry is easy to dewater. This process is efficient because the agglomeration is carried out while the slurry is being loaded into the ship.

Figure 9:
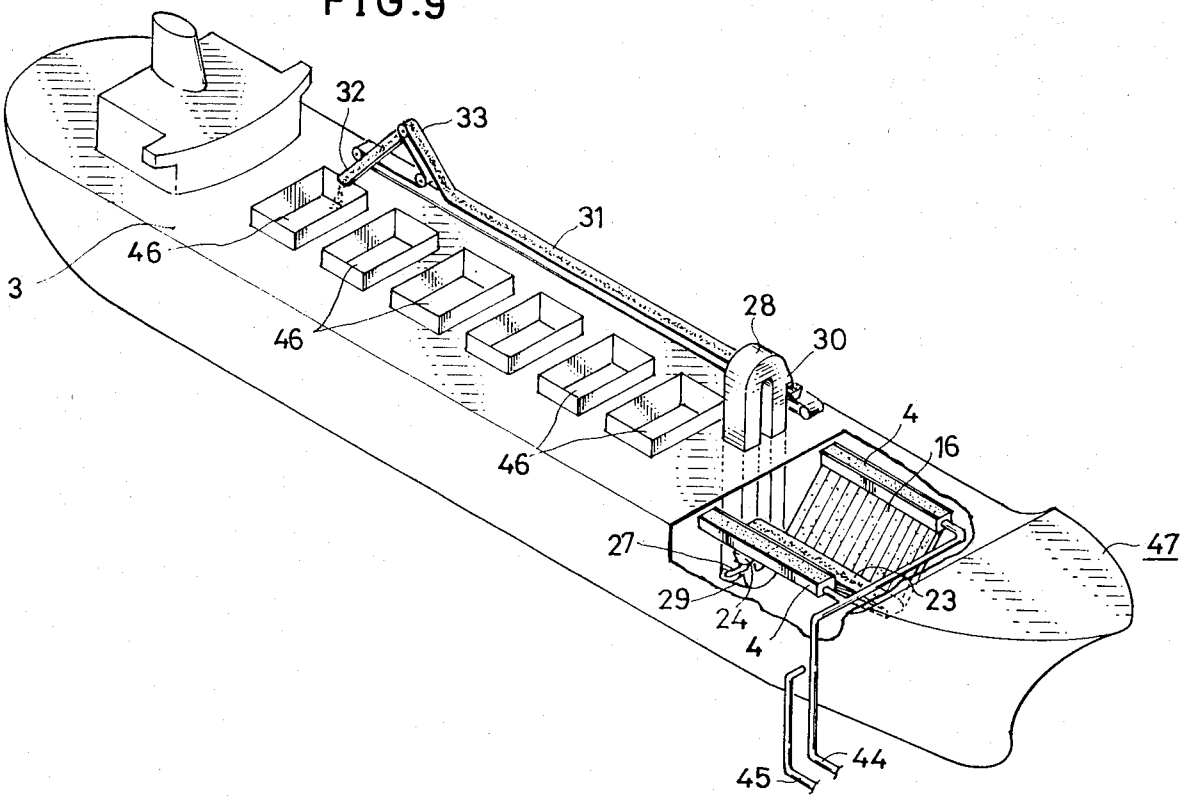
FIG. 9 is a perspective view showing another coal slurry treating ship embodying the invention.
Figure 10:
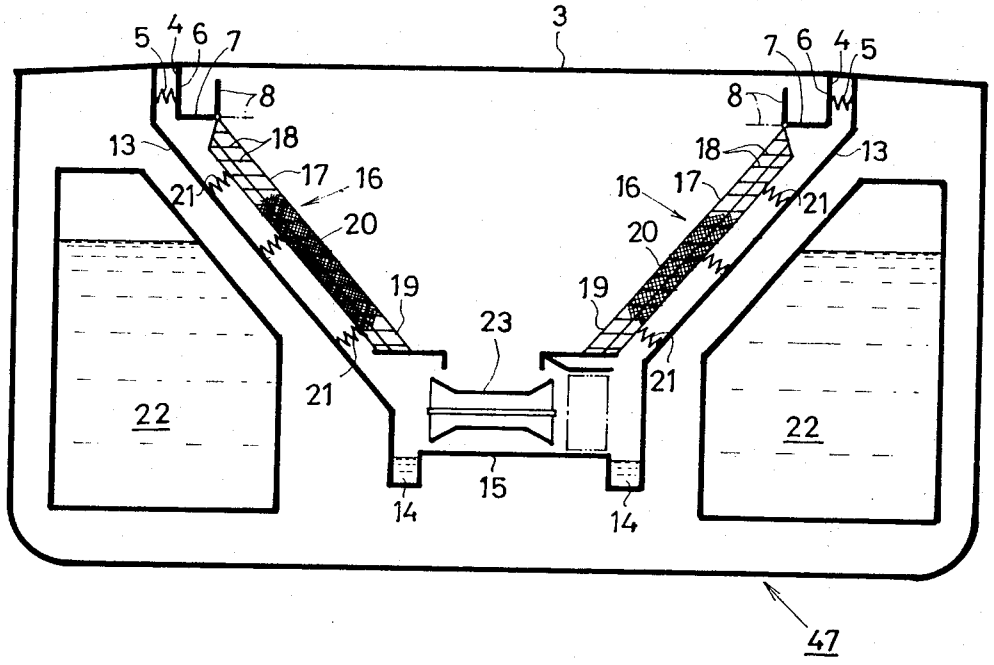
FIG. 10 is a cross sectional view showing the ship of FIG. 9.
Figure 11:
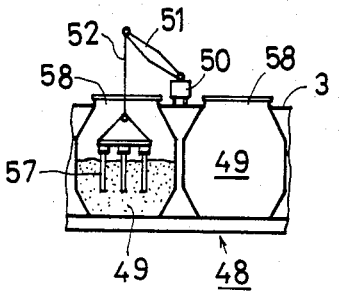
FIG. 11 is a view in vertical section showing holds of another coal slurry treating ship embodying the invention.
Figure 13:
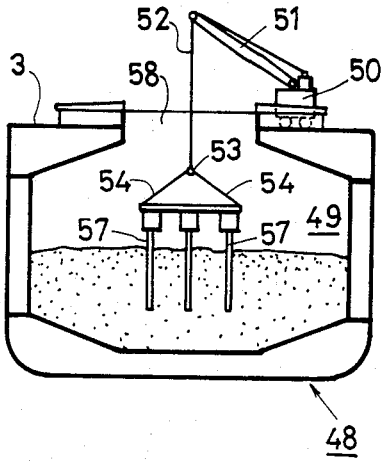
FIG. 13 is an enlarged cross sectional view showing one of the holds illustrated in FIG. 11.
Figure 12:
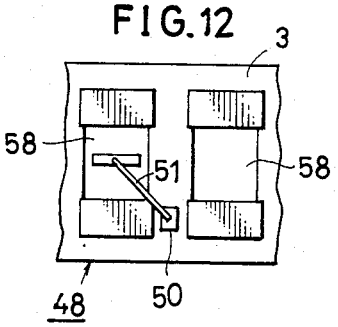
FIG. 12 is a plan view corresponding to FIG. 11.
Figure 14:
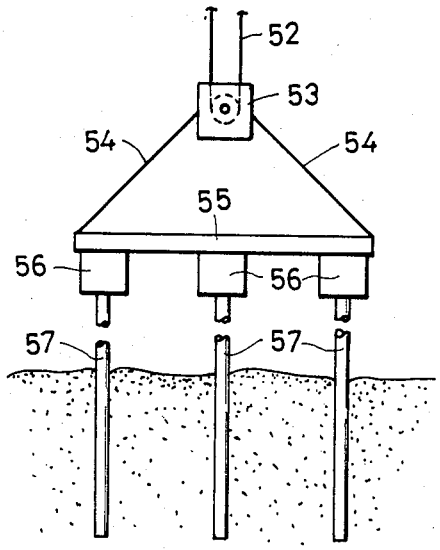
FIG. 14 is a fragmentary enlarged view of FIG. 13.

FIGS. 9 and 10 show another embodiment of the invention. Throughout the accompanying drawings, like parts are referred to by like reference numerals.

A coal slurry transport ship 47 has a plurality of holds and serves also as a coal slurry transport ship. A coal slurry is transferred from shore to the ship 47, loaded into the holds of its own while being dewatered and transported.

Opposed trays 4 are provided immediately below the upper deck 3 in the forepart of the ship. The fore-and-aft lengths of the trays 4, dewatering screens 16 and belt conveyor 23 of metal netting are smaller than those of the foregoing embodiment, with the result that a bucket conveyor 28 is positioned toward the bows. The holds are arranged abaft the conveyor 28. One belt conveyor 31 is installed on the upper deck 3 abaft the bucket conveyor 28 at one side of the ship. A movable loader 32 extends from the position of an upward branch portion 33 of the conveyor 31 toward the center of the hull.

A coal slurry supplied to the ship 47 from a facility on shore through a floating hose 44 is dewatered in the same manner as in the above embodiment, and the dewatered particulate coal is transferred onto the belt conveyor 31 and placed into one hold after another. On the other hand, the slurry water passing through the screens 16 flows down slanting plates 13 into drain channels 14 and is led into tanks 22 by suitable means along with the slurry water passing through the netting belt conveyor 23 into the channels 14 and the slurry water collected by a drain pipe 26 for a hopper 24. The water is further returned to the shore facility via a floating hose 45.

FIGS. 11 to 14 show another embodiment of the invention, namely a coal slurry treating ship 48.

The ship 48 serves also as a coal slurry transport ship. Like the embodiment of FIGS. 9 and 10, the ship is equipped with a plurality of holds 49 and an unillustrated apparatus for dewatering a coal slurry and loading the dewatered particulate coal into the holds 49. A plurality of trucks 50 are arranged on the upper deck 3 of the ship 48, each truck 50 for a number of holds 49. Each truck 50 has a boom 51, a pulley assembly 53 suspended from the forward end of the boom 51 by a wire rope 52, and a horizontal beam 55 suspended from the pulley assembly 53 by a wire rope 54. Three vibrators 56 are attached to the bottom of the beam 55. A vibrator rod 57 extends vertically downward from each of the vibrators 56, which comprises the combination of a motor and an eccentric rotor or an electromagnet for vibrating the rod 57.

A coal slurry is loaded into the ship 48 in the same manner as in the embodiment of FIGS. 9 and 10. During the loading, the vibrators 56 are operated in the following manner to consolidate the mass of dewatered particulate coal placed into the holds 49. After an amount of particulate coal has been placed into the hold 49, the vibrators 56 are lowered into the hold 49 through a hatch 58 to insert the vibrator rods 57 into the mass of coal by suitably moving the truck 50, swiveling and inclining the boom 51, and winding and paying off the wire rope 52. The vibrators 56 are then operated to vibrate the rods 57, whereby the mass of coal is consolidated, reducing the voids between the coal particles. With an increase in the quantity of particulate coal within the hold 49, the wire rop 52 is wound up to gradually raise the vibrators 56. When the hold 49 has been filled with consolidated particulate coal, the vibrator rods 57 are fully raised above the hatch 58. The same consolidating procedure is thereafter repeated for another hold 49.

With the ship of FIGS. 11 to 14, the mass of dewatered particulate coal placed into the hold 49 can be consolidated or compacted by the vibrators 56 to reduce the voids therein. This increases the amount of coal to be loaded in the hold 49, enabling the ship to achieve a greatly improved coal transport efficiency.

What is claimed is:

1. A ship for treating a coal slurry comprising coal slurry delivery means disposed in the vicinity of the upper deck for causing the coal slurry supplied thereto to flow forward and delivering the slurry, a slanting dewatering screen in the form of waves in horizontal section disposed below the delivery means for dewatering the coal slurry delivered from the delivery means to separate out a particulate coal fraction having relatively large particle sizes, and conveyor means for transporting to a specified position on the upper deck the particulate coal fraction dewatered and falling off the screen, and wherein the coal slurry delivery means is a tray having one end for admitting the coal slurry therethrough, the other end being closed, and an openable side plate.

2. A ship as defined in claim 1 wherein the tray and the dewatering screen are mounted on the hull of the ship by springs and provided with vibrating means.

3. A ship as defined in either claim 1 or 2 wherein the conveyor means comprises a first belt conveyor disposed below the dewatering screen, a bucket conveyor for transporting the dewatered particulate coal fraction from the terminal end of the conveyor to above the upper deck, a second belt conveyor mounted on the upper deck for transporting lengthwise of the ship the particulate coal fraction delivered from the bucket conveyor, and a loader mounted on the upper deck and movable lengthwise of the ship for receiving the paticulate coal fraction from the second belt conveyor and delivering the fraction from the ship.

4. A ship for treating a coal slurry comprising coal slurry delivery means disposed in the vicinity of the upper deck for causing the coal slurry supplied thereto to flow forward and delivering the slurry, a slanting dewatering screen in the form of waves in horizontal section disposed below the delivery means for dewatering the coal slurry delivered from the means to separate a particulate coal fraction having relatively large particle sizes, conveyor means for transporting to a specified position on the upper deck the particulate coal fraction dewatered and falling off the screen, and an agglomerating apparatus for agglomerating fine coal particles in the slurry water passing through the dewatering screen, dewatering the resulting coal agglomerates and transporting the dewatered agglomerates to a specified portion of the conveyor means.

5. A ship as defined in claim 4 wherein the coal slurry delivery means is a tray having one end for admitting the coal slurry therethrough, the other end which is closed and an openable side plate.

6. A ship as defined in claim 5 wherein the tray and the dewatering screen are mounted on the hull of the ship by springs and provided with vibrating means.

7. A ship as defined in any one of claims 4 to 6 wherein the conveyor means comprises a first belt conveyor disposed below the dewatering screen, a bucket conveyor for transporting the dewatered particulate coal fraction from the terminal end of the conveyor to above the upper deck, a second belt conveyor mounted on the upper deck for transporting lengthwise of the ship the particulate coal fraction delivered from the bucket conveyor, and a loader mounted on the upper deck and movable lengthwise of the ship for receiving the particulate coal fraction from the second belt conveyor and delivering the fraction from the ship.

8. A ship as defined in claim 7 wherein the agglomerating apparatus comprises an agglomerating pipe having an oil adding nozzle in the vicinity of its starting end and agitating blades in its interior, a water feeder for supplying the slurry water passing through the dewatering screen to the terminal end of the agglomerating pipe, a dewatering unit for dewatering the agglomerates delivered from the terminal end of the agglomerating pipe, and a bucket conveyor for transporting to the second belt conveyor on the upper deck the agglomerates dewatered and delivered from the dewatering unit.

9. A ship as defined in any one of claims 4 to 6 wherein the agglomerating apparatus comprises an agglomerating pipe having an oil adding nozzle in the vicinity of its starting end and agitating blades in its interior, a water feeder for supplying the slurry water passing through the dewatering screen to the terminal end of the agglomerating pipe, a dewatering unit for dewatering the agglomerates delivered from the terminal end of the agglomerating pipe, and means for transporting to the specified portion of the conveyor means the agglomerates dewatered and delivered from the dewatering unit.

10. A ship for treating a coal slurry comprising a plurality of holds, coal slurry delivery means disposed in the vicinity of the upper deck for causing the coal slurry supplied thereto to flow forward and delivering the slurry, a slanting dewatering screen in the form of waves in horizontal section disposed below the delivery means for dewatering the coal slurry delivered from the means to separate a particulate coal fraction having relatively large particle sizes, and conveyor means for transporting to a position above the upper deck the particulate coal fraction dewatered and falling off the screen and for loading the fraction into the holds, and wherein the coal slurry delivery means is a tray having one end for admitting the coal slurry therethrough, the other end being closed and an openable side plate.

11. A ship as defined in claim 10 wherein the tray and the dewatering screen are mounted on the hull of the ship by springs and provided with vibrating means.

12. A ship as defined in either claim 10 or 11 wherein the conveyor means comprises a first belt conveyor disposed below the dewatering screen, a bucket conveyor for transporting the dewatered particulate coal fraction from the terminal end of the conveyor to above the upper deck, a second belt conveyor mounted on the upper deck for transporting lengthwise of the ship the particulate coal fraction delivered from the bucket conveyor, and a loader mounted on the upper deck and movable lengthwise of the ship for receiving the particulate coal fraction from the second belt conveyor and loading the fraction into the holds.

* * * * *